US007326321B2

(12) United States Patent
Hikida

(10) Patent No.: US 7,326,321 B2
(45) Date of Patent: Feb. 5, 2008

(54) SHOE PRESS BELTS AND SHOE PRESS DEVICE USING THE BELTS

(75) Inventor: Takahisa Hikida, Hirakata (JP)

(73) Assignee: Yamauchi Corporation, Hirakata-Shi (JP)

( * ) Notice: Subject to any disclaimer, the term of this patent is extended or adjusted under 35 U.S.C. 154(b) by 328 days.

(21) Appl. No.: 10/510,484

(22) PCT Filed: Apr. 3, 2003

(86) PCT No.: PCT/JP03/04300

§ 371 (c)(1),
(2), (4) Date: Oct. 7, 2004

(87) PCT Pub. No.: WO03/085195

PCT Pub. Date: Oct. 16, 2003

(65) Prior Publication Data

US 2005/0274475 A1 Dec. 15, 2005

(30) Foreign Application Priority Data

Apr. 11, 2002 (JP) ..... 2002-109545

(51) Int. Cl.
*D21F 3/00* (2006.01)

(52) U.S. Cl. ..... 162/358.4; 162/901; 428/163; 428/167

(58) Field of Classification Search ..... 162/116, 162/117, 205–207, 306, 348, 358.3, 358.4, 162/361, 901; 428/163, 167, 156, 157, 332, 428/339; 442/59, 181, 64–73, 104, 105, 442/164; 100/151, 153
See application file for complete search history.

(56) References Cited

U.S. PATENT DOCUMENTS

| | | | | |
|---|---|---|---|---|
| 6,030,503 | A * | 2/2000 | Matuschczyk | 162/358.4 |
| 7,097,741 | B2 * | 8/2006 | Watanabe et al. | 162/358.4 |

FOREIGN PATENT DOCUMENTS

| | | | |
|---|---|---|---|
| DE | 44 01 580 | * | 6/1994 |
| EP | 0 414 629 | A1 | 2/1991 |
| EP | 0 886 004 | A1 | 12/1998 |
| EP | 0 978 588 | A2 | 2/2000 |
| EP | 1 382 737 | | 1/2004 |
| JP | 8-13373 | * | 1/1996 |
| JP | 08-013373 | A | 1/1996 |
| JP | 11-012975 | A | 1/1999 |
| JP | 2002-327389 | A | 11/2002 |
| WO | WO 02/090649 | * | 11/2002 |

* cited by examiner

*Primary Examiner*—Eric Hug
(74) *Attorney, Agent, or Firm*—Birch, Stewart, Kolasch & Birch, LLP

(57) ABSTRACT

In a shoe press belt (11; 21; 31; 41; 51; 61) endlessly formed by an elastic material, a plurality of drains (15; 25; 35; 45; 55; 65) are formed on the outer peripheral surface of the shoe press belt along the peripheral direction of the shoe press belt, and the depths of these drains are progressively increased from a central pressurizing portion ($C_1$; $C_2$; $C_3$; $C_4$; $C_5$) toward end pressurizing portions ($A_1$, $A_1'$; $A_2$, $A_2'$; $A_3$, $A_3'$; $A_4$, $A_4'$; $A_5$, $A_5'$) of the shoe press belt. A shoe press employing this shoe press belt. Thus, a shoe press belt capable of uniformly dehydrating the overall wet web and a shoe press employing the same can be provided.

5 Claims, 8 Drawing Sheets

SHOE PRESS BELTS AND SHOE PRESS DEVICE USING THE BELTS

TECHNICAL FIELD

The present invention relates to a shoe press belt and a shoe press employing the same, and more particularly, it relates to a shoe press belt capable of uniformly dehydrating the overall wet web and a shoe press employing the same.

BACKGROUND

In general, the so-called shoe press is widely used in place of a roll press in dehydration pressing in the paper industry. Briefly stated, the shoe press is a device pressing a first surface of wet web to be pressurized with a press roll or the like while pressurizing a second surface with a pressure shoe having a prescribed width in the running direction through a press belt thereby dehydrating the wet web. While a roll press performing pressing with two rolls applies linear pressure to an object to be pressurized, the shoe press provided with the pressure shoe having the prescribed width in the running direction can apply area pressure to the object to be pressurized. When performing dehydration pressing with the shoe press, therefore, a nip width can be increased for advantageously improving dehydration efficiency. The press belt is endlessly formed by an elastic material such as thermosetting polyurethane.

FIG. 7 is a schematic sectional view of an exemplary conventional shoe press 70. Referring to FIG. 7, wet web 73 held between a top felt member 71 and a bottom felt member 72 is transported into the clearance between a press roll 74 and a shoe press belt 75, and dehydrated by pressure formed between the press roll 74 and the belt 75. Both ends of the belt 75 are fixed to discs 79 rotatably supported on both ends of an unrotating support 78 through bearings. The belt 75 rotates in a driven manner following rotation of the press roll 74 while sliding on a pressure shoe 76. The pressure shoe 76 set on the lower surface of the belt 75 applies pressure to a pressurizing region A-A', and this pressure is regulated in response to the pressure of oil injected into hydraulic cylinders 77 set on the lower portion of the pressure shoe 76 through the support 78. A plurality of drains 80 are formed on the outer peripheral surface of the shoe press belt 75 along the peripheral direction of the belt 75 with a uniform depth, so that drained water is discharged from the shoe press 70 through the drains 80.

The dehydration ability of the conventional shoe press 70 is remarkably influenced by the depth of the drains 80 formed on the outer peripheral surface of the shoe press belt 75. In other words, a large quantity of water can be drained from the wet web 73 if the pressure formed between the press roll 74 and the belt 75 is high, while the drained water cannot be sufficiently discharged from the shoe press 70 if the drains 80 are shallow.

The dehydration ability of the conventional shoe press 70 is disadvantageously readily reduced in the vicinity of end pressurizing portions A and A'. This is because the own weight of the large-sized support 78 of metal as well as depression of the press roll 74 deflect a portion close to a central pressurizing portion C as in a support 78*a* shown in FIG. 8, and the pressure on the end pressurizing portions A and A' is increased as compared with that on the central pressurizing portion C. In other words, a shoe press belt 75*a* is remarkably worn in the vicinity of the end pressurizing portions A and A' as compared with the central pressurizing portion C due to this deflection of the support 78*a* to reduce the depths of the drains 80 in the vicinity of the end pressurizing portions A and A', leading to reduction of dehydration ability for the wet web 73 in the vicinity thereof Therefore, the conventional shoe press 70 cannot uniformly dehydrate the overall wet web 73 but causes a problem such as web break in a papermaking step and deterioration of the quality resulting from nonuniform paper strength.

In consideration of the aforementioned circumstances, an object of the present invention is to provide a shoe press belt capable of uniformly dehydrating the overall wet web and a shoe press employing the same.

DISCLOSURE OF THE INVENTION

The present invention is characterized in that, in a shoe press belt endlessly formed by an elastic material, a plurality of drains are formed on the outer peripheral surface of the shoe press belt along the peripheral direction of the shoe press belt, and the depths of the drains are progressively increased from a central pressurizing portion toward end pressurizing portions of the shoe press belt.

In the shoe press belt according to the present invention, the depths of the aforementioned drains are preferably progressively increased from the central pressurizing portion toward the end pressurizing portions of the shoe press belt by at least one type of technique among a curve technique, a linear technique, a stepped technique and a trapezoidal technique.

In the shoe press belt according to the present invention, the depths of the drains are preferably so progressively increased that the depth of the deepest drain formed in a pressurizing region of the shoe press belt is 1.05 to 3.0 times the depth of the shallowest drain formed in the pressurizing region.

In the shoe press belt according to the present invention, the thickness of the shoe press belt is preferably progressively reduced from the central pressurizing portion toward the end pressurizing portions of the shoe press belt.

The shoe press according to the present invention comprises at least the aforementioned shoe press belt, a pressure shoe applying pressure to the aforementioned shoe press belt and pressure regulation means regulating the pressure of the pressure shoe.

BEST MODES FOR CARRYING OUT THE INVENTION

Embodiments of the shoe press belt according to the present invention are now described.

First Embodiment

Figure 1:
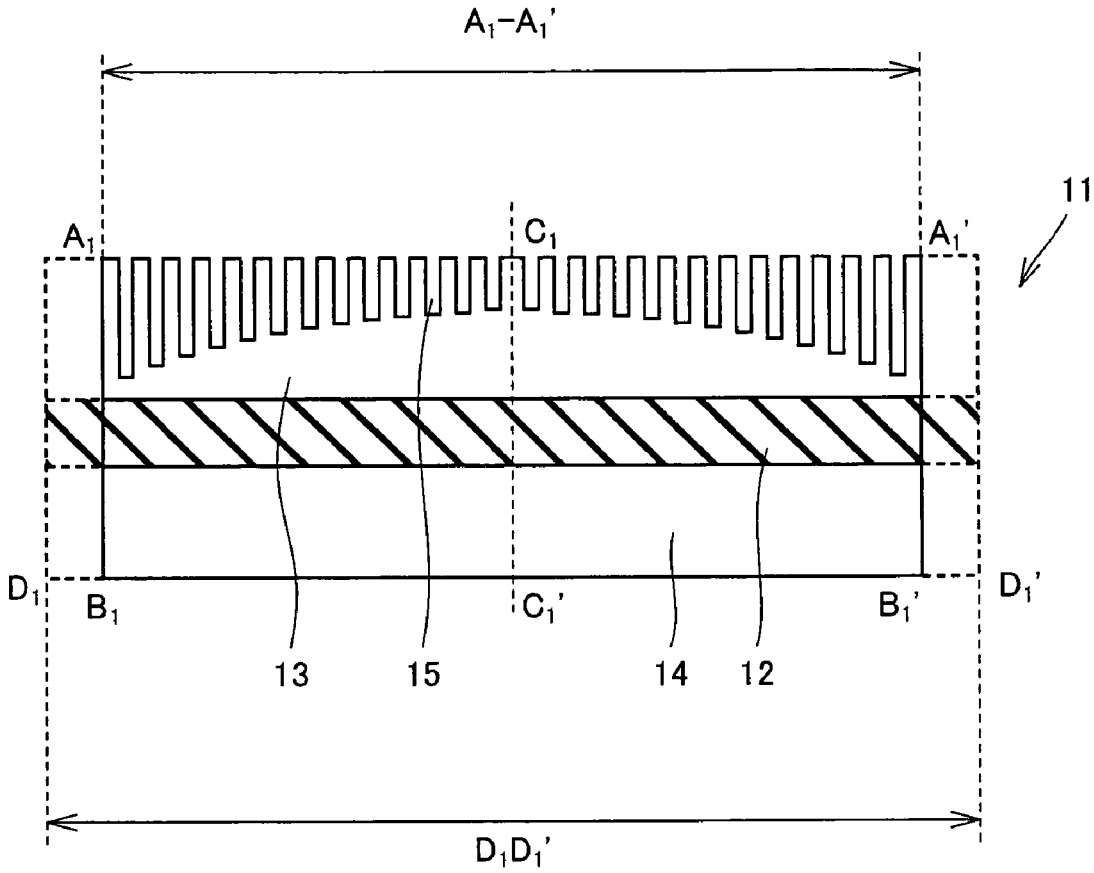
FIG. 1 is a schematic sectional view of a shoe press belt according to a first embodiment.

FIG. 1 is a schematic sectional view of a shoe press belt 1, an example of the inventive shoe press belt, according to a first embodiment. In the shoe press belt 11 according to the first embodiment, a reinforcing layer 12 impregnated with an elastic material into a cylindrical endless reinforcing base is set between a first elastic layer 13 and a second elastic layer 14 set on the outer peripheral surface and the inner peripheral surface of the aforementioned reinforcing base respectively, and the first elastic layer 13 and the second elastic layer 14 are integrated with the elastic material of the reinforcing layer 12 impregnated into the reinforcing base. A plurality of drains 15 are formed on the outer peripheral surface of the shoe press belt 11.

As shown in FIG. 1, the shoe press belt 11 according to the first embodiment is characterized in that the depths of the drains 15 formed in the first elastic layer 13 are curvedly progressively increased as shown in FIG. 1, for example, from a central pressurizing portion $C_1$ toward end pressurizing portions $A_1$ and $A_1'$ in a pressurizing region $A_1$-$A_1'$ of the first elastic layer 13. This is because the inventor has found out that pressure applied to the end pressurizing portions $A_1$ and $A_1'$ of the shoe press belt 11 is higher than that applied to the central pressurizing portion $C_1$, and also found out that a shoe press is not reduced in dehydration ability in the vicinity of the aforementioned end pressurizing portions but can uniformly dehydrate the overall wet web when the depths of the drains 15 are progressively increased from the central pressurizing portion $C_1$ toward the end pressurizing portions $A_1$ and $A_1'$, even if the shoe press belt 11 is worn in the vicinity of the aforementioned end pressurizing portions.

The term "progressively increased" means that a plurality of drains 15 having at least three types of different depths are lined up and formed along the central pressurizing portion $C_1$ and the end pressurizing portions $A_1$ and $A_1'$ of the shoe press belt 11 in order of the depths of the aforementioned drains 15. When the plurality of drains 15 having at least three types of different depths are lined up and formed in order of the depths, therefore, it is also possible to line up and form a plurality of drains 15 of the same depth thereamong. The end pressurizing portions $A_1$ and $A_1'$ are located on positions separated from an end $D_1$ or $D_1'$ of the overall width of the shoe press belt 11 by a length of 0.1 to 10.0% of the overall width $D_1D_1'$ of the shoe press belt 11, and the central pressurizing portion $C_1$ is located at the center of the pressurizing region $A_1$-$A_1'$.

The shape of the papermaking press belt 11 is not particularly restricted except the pressurizing region $A_1$-$A_1'$.

The depths of the drains are preferably so progressively increased that the depth of the deepest drain formed in the pressurizing region $A_1$-$A_1'$ of the shoe press belt 11 is 1.05 to 3.0 times, more preferably 1.1 to 2.0 times, further preferably 1.2 to 1.5 times the depth of the shallowest drain formed in the pressurizing region. In this case, the formed drains keep depths sufficient for squeezing even if the shoe press belt 11 is worn in the vicinity of the end pressurizing portions, whereby the shoe press can be further effectively prevented from reduction of the dehydration ability on the end pressurizing portions for uniformly dehydrating the overall wet web. The shoe press belt 11 is a large-sized belt having a width of 2 to 15 m, a peripheral length of 1 to 30 m and a thickness of 2 to 10 mm in general. The depths of the drains 15 are about 0.5 to 7 mm.

The drains 15 are formed along the peripheral direction of the shoe press belt 11 having a cylindrical shape. The term "peripheral direction of the shoe press belt 11" means a direction included in such a range that the angle formed by the peripheral direction of the shoe press belt 11 and the direction of the drains 15 is 0° to 5°. The shapes of the individual drains 15 and the intervals between the individual drains 15 are not particularly restricted.

The aforementioned shoe press belt 11 may be manufactured by a method of impregnating the reinforcing layer 12 consisting of a cylindrical endless reinforcing base with an elastic material, hardening this elastic material thereby forming the first elastic layer 13 and the second elastic layer 14 and thereafter forming the plurality of drains from the central pressurizing portion $C_1$ toward the end pressurizing portions $A_1$ and $A_1'$ of the first elastic layer 13 in the aforementioned manner by cutting, polishing or the like, for example.

The reinforcing base impregnated with the elastic material can be prepared from woven fabric or nonwoven fabric, for example. While generally known woven fabric can be employed as the woven fabric, for example, multiple cloth such as warp triple cloth, warp quadruple cloth or the like is preferably employed, for example. In this case, the woven fabric includes such a large number of voids that the degree of impregnation with the elastic material can be improved for attaining a sufficient anchor effect between the elastic material and the reinforcing base, whereby delamination between the elastic material and the reinforcing base can be prevented. The nonwoven fabric can be formed by dry nonwoven fabric prepared by a method such as thermal bonding, chemical bonding or air layering, wet nonwoven fabric prepared by bonding fiber with a binder or the like or nonwoven fabric prepared by a method such as spun lacing, spun bonding, melt blowing, needle punching or stitch bonding.

At least one type of natural fiber and/or at least one type of synthetic fiber can be employed as the material(s) for the aforementioned woven or nonwoven fabric. The natural fiber includes fiber such as cotton, hemp, silk or wool, for example. The synthetic fiber includes fiber such as rayon, polyester, acrylic, polypropylene, polyethylene, ultrahigh-molecular polyethylene, polyvinyl alcohol, polyurethane, polyamide, total aromatic polyamide, carbon, glass, metal or fluorine, for example.

At least one type of rubber and/or at least one type of thermoplastic elastomer can be employed as the elastic material. The rubber includes butyl rubber, natural rubber, butadiene rubber, isoprene rubber, chloroprene rubber, ethylene-propylene rubber, styrene-butadiene rubber, styrene-butadiene-styrene rubber, nitrile rubber, polynorbornene rubber, acrylic rubber, urethane rubber, silicone rubber or epichlorohydrin rubber, for example. The thermoplastic elastomer includes styrene-based, olefin-based, ester-based, polyamide-based, vinyl chloride-based or urethane-based thermoplastic elastomer, for example.

Reinforcing filamentous bodies can be arranged in the first elastic layer 13 and the second elastic layer 14. In this case, the mechanical strength of the shoe press belt according to the present invention can be improved. The aforementioned at least one type of natural fiber and/or at least one type of synthetic fiber can be employed for the reinforcing filamentous bodies, for example. The reinforcing filamentous bodies are preferably prepared from at least one type of fiber selected from inorganic fiber such as carbon fiber, glass fiber, boron fiber, alumina fiber, potassium titanate fiber, silica fiber or zirconia fiber or organic fiber such as total aromatic polyamide fiber, total aromatic polyester fiber, ultrahigh-molecular polyethylene fiber, high-strength vinylon fiber or high-strength acrylic fiber. In this case, the strength of the shoe press belt 11 according to the present invention can be further improved.

The aforementioned reinforcing filamentous bodies can be used in the form of bundles of filaments, thread, roving or cords. Further, the reinforcing filamentous bodies can be arranged in unidirectional or multidirectional combination selected from the peripheral direction, the width direction and the oblique direction of the shoe press belt 11.

Second Embodiment

Figure 2:
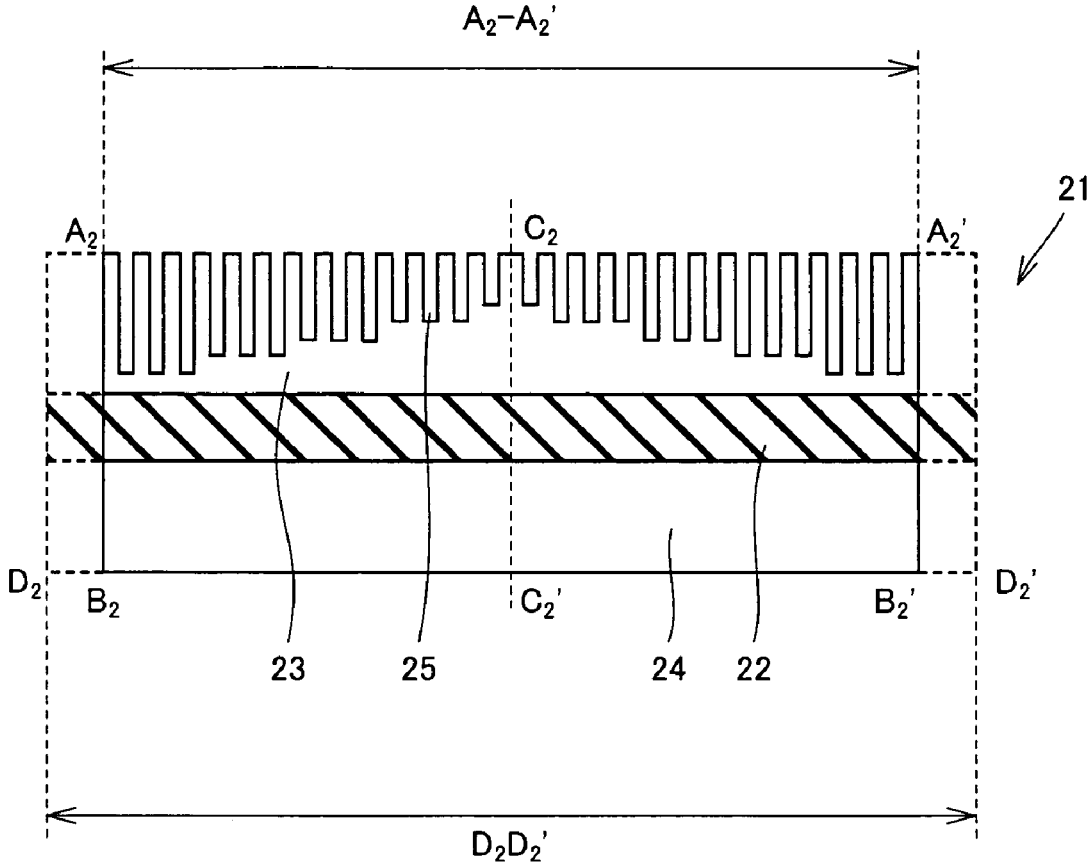
FIG. 2 is a schematic sectional view of a shoe press belt according to a second embodiment.

FIG. 2 is a schematic sectional view of a shoe press belt 21, an example of the inventive press belt, according to a second embodiment. In the shoe press belt 21 according to the second embodiment, a reinforcing layer 22 is set between a first elastic layer 23 and a second elastic layer 24 set on the outer peripheral surface and the inner peripheral surface of a cylindrical endless reinforcing base respectively, and the first elastic layer 23 and the second elastic layer 24 are integrated with an elastic material of the reinforcing layer 22 impregnated into the reinforcing base. A plurality of drains 25 are formed on the outer peripheral surface of the shoe press belt 21.

In the shoe press belt 21 according to the second embodiment, the depths of the drains 25 formed in the first elastic layer 23 are progressively increased stepwise as shown in FIG. 2, for example, from a central pressurizing portion $C_2$ toward end pressurizing portions $A_2$ and $A_2'$ in a pressurizing region $A_2$-$A_2'$ of the first elastic layer 23. The remaining points of the second embodiment are similar to those of the first embodiment.

Third Embodiment

Figure 3:
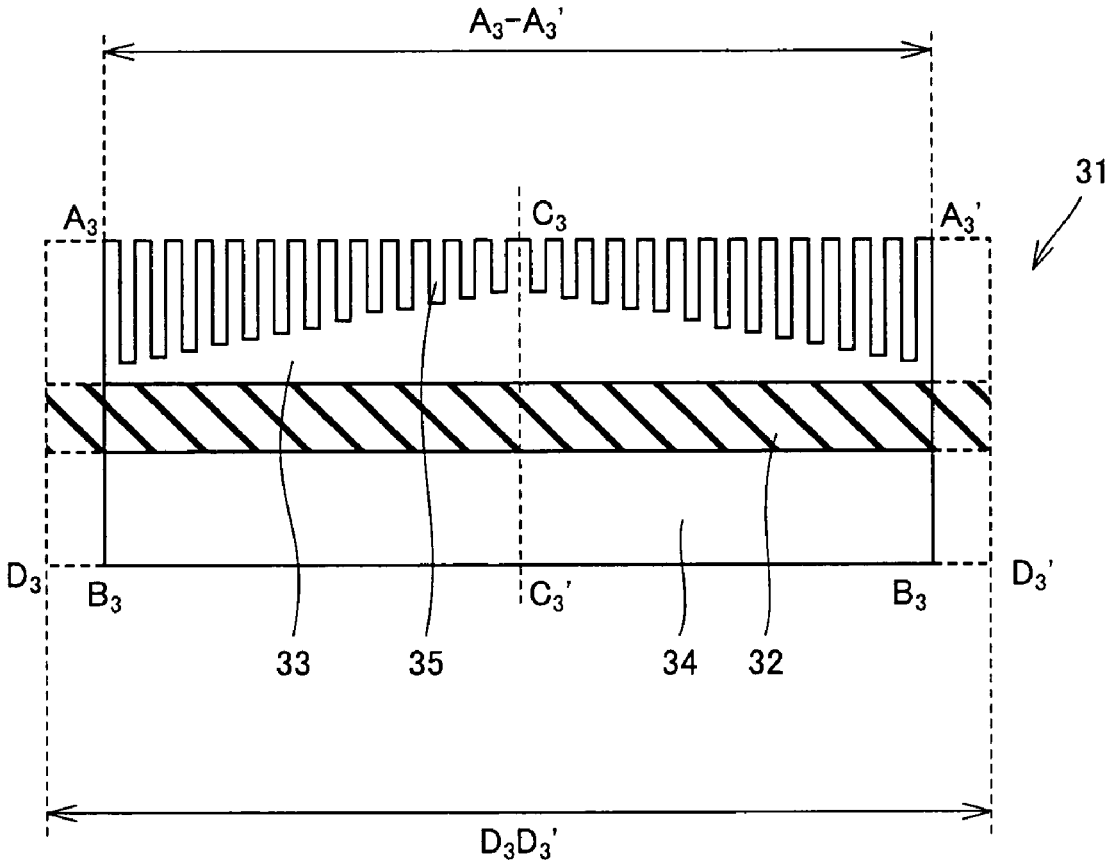
FIG. 3 is a schematic sectional view of a shoe press belt according to a third embodiment.

FIG. 3 is a schematic sectional view of a shoe press belt 31, an example of the inventive press belt, according to a third embodiment. In the shoe press belt 31 according to the third embodiment, a reinforcing layer 32 is set between a first elastic layer 33 and a second elastic layer 34 set on the outer peripheral surface and the inner peripheral surface of a cylindrical endless reinforcing base respectively, and the first elastic layer 33 and the second elastic layer 34 are integrated with an elastic material of the reinforcing layer 32 impregnated into the reinforcing base. A plurality of drains 35 are formed on the outer peripheral surface of the shoe press belt 31.

In the shoe press belt 31 according to the third embodiment, the depths of the drains 35 formed in the first elastic layer 33 are linearly progressively increased as shown in FIG. 3, for example, from a central pressurizing portion $C_3$ toward end pressurizing portions $A_3$ and $A_3'$ in a pressurizing region $A_3$-$A_3'$ of the first elastic layer 33. The remaining points of the third embodiment are similar to those of the first and second embodiments.

Fourth Embodiment

Figure 4:
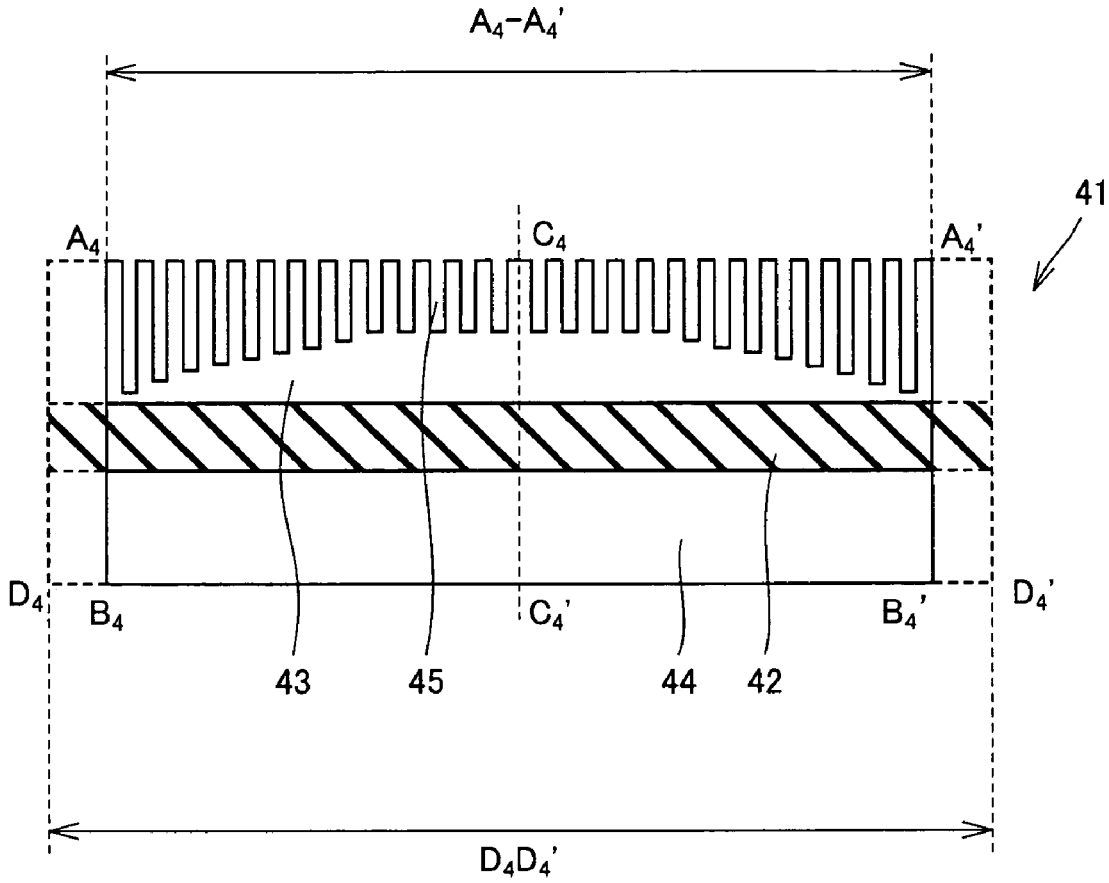
FIG. 4 is a schematic sectional view of a shoe press belt according to a fourth embodiment.

FIG. 4 is a schematic sectional view of a shoe press belt 41, an example of the inventive press belt, according to a fourth embodiment. In the shoe press belt 41 according to the fourth embodiment, a reinforcing layer 42 is set between a first elastic layer 43 and a second elastic layer 44 set on the outer peripheral surface and the inner peripheral surface of a cylindrical endless reinforcing base respectively, and the first elastic layer 43 and the second elastic layer 44 are integrated with an elastic material of the reinforcing layer 42 impregnated into the reinforcing base. A plurality of drains 45 are formed on the outer peripheral surface of the shoe press belt 41.

In the shoe press belt 41 according to the fourth embodiment, the depths of the drains 45 formed in the first elastic layer 43 are progressively increased in a trapezoidal manner as shown in FIG. 4, for example, from a central pressurizing portion $C_4$ toward end pressurizing portions $A_4$ and $A_4'$ in a pressurizing region $A_4$-$A_4'$ of the first elastic layer 43. The remaining points of the fourth embodiment are similar to those of the first to third embodiments.

Fifth Embodiment

Figure 5:
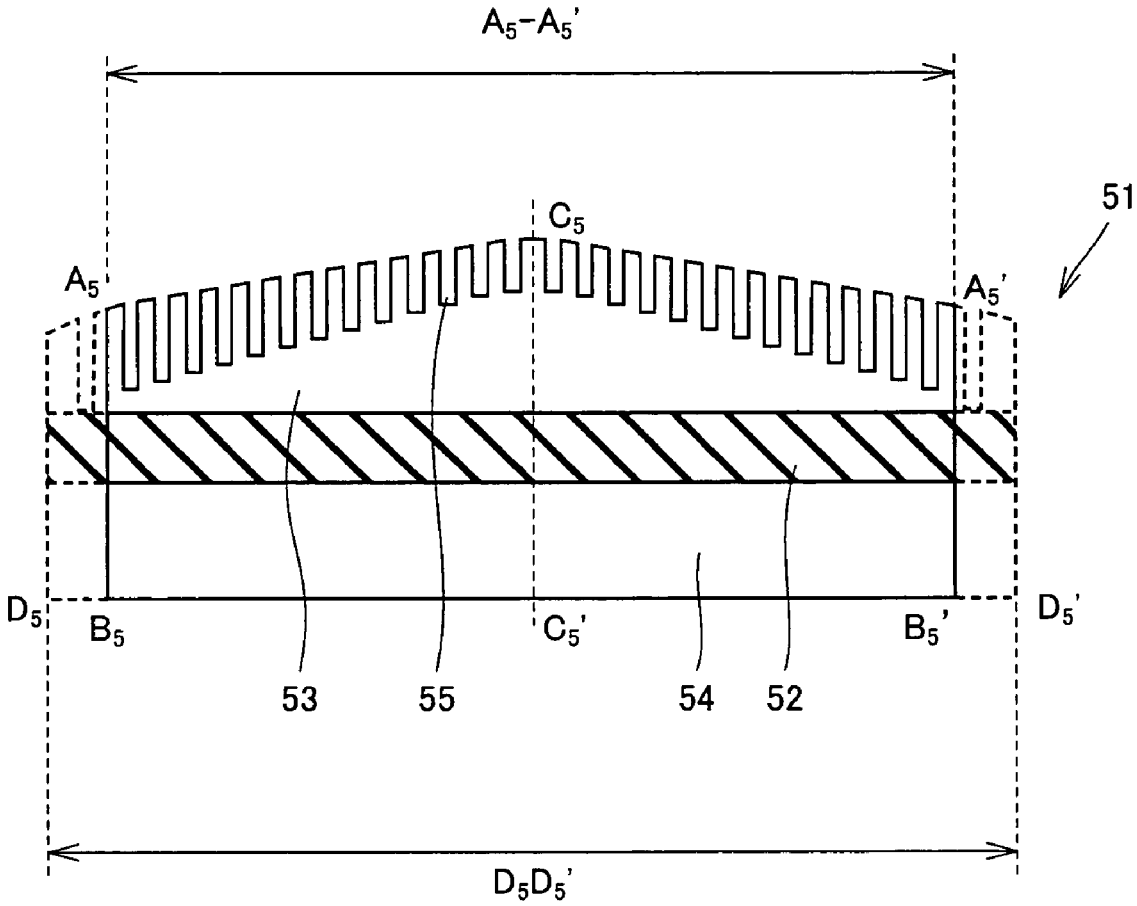
FIG. 5 is a schematic sectional view of a shoe press belt according to a fifth embodiment.

FIG. 5 is a schematic sectional view of a shoe press belt 51, an example of the inventive press belt, according to a fifth embodiment. In the shoe press belt 51 according to the fifth embodiment, a reinforcing layer 52 is set between a first elastic layer 53 and a second elastic layer 54 set on the outer peripheral surface and the inner peripheral surface of a cylindrical endless reinforcing base respectively, and the first elastic layer 53 and the second elastic layer 54 are integrated with an elastic material of the reinforcing layer 52 impregnated into the reinforcing base. A plurality of drains 55 are formed on the outer peripheral surface of the shoe press belt 51.

In the shoe press belt 51 according to the fifth embodiment, the depths of the drains 55 are progressively increased from a central pressurizing portion $C_5$ toward end pressurizing portions $A_5$ and $A_5'$ in a pressurizing region $A_5$-$A_5'$ of the first elastic layer 53, while the thickness of the fist elastic layer 53 is progressively reduced from the central pressurizing portion $C_5$ toward the respective end pressurizing portions $A_5$ and $A_5'$. In the shoe press belt 51 according to the fifth embodiment, the thickness of the belt 51 is progressively reduced from the central pressurizing portion $C_5$ toward the end pressurizing portions $A_5$ and $A_5'$, whereby the belt 51 can be prevented or released from remarkable wear from the central pressurizing portion $C_5$ toward the end pressurizing portions $A_5$ and $A_5'$. Even if portions around the end pressurizing portions $A_5$ and $A_5'$ are worn, the drains 55 in the vicinity of the end pressurizing portions $A_5$ and $A_5'$ still have depths sufficient for squeezing, whereby durability of the belt 51 can be remarkably improved.

The thickness of the aforementioned first elastic layer 53, which can be progressively reduced in a crown curve shape, a linear shape, a stepped shape or a trapezoidal shape, for example, is preferably so progressively reduced as to crown a curve connecting the portions $A_5$, $C_5$ and $A_5'$ with each other in particular. In this case, the applied pressure is locally changed on no portion, whereby the uniformity of the pressure applied to the wet web is improved. In the shoe press belt 51 according to the fifth embodiment, further, the thickness of not the first elastic layer 53 but the second elastic layer 54 can be progressively reduced, or the thicknesses of both of the first elastic layer 53 and the second elastic layer 54 can be progressively reduced. When the thicknesses of both of these layers are progressively reduced, the methods of progressively reducing the thicknesses are preferably identical to each other, while the same may be different from each other. The remaining points of the fifth embodiment are similar to those of the first to fourth embodiments.

Also in the shoe press belt according to each of the first to fourth embodiments, the thickness(es) of the first elastic layer, the second elastic layer or both of these layers can be progressively reduced from the central pressurizing portion toward the end pressurizing portions. The thickness(es), which can be progressively reduced in a crown curve shape, a linear shape, a stepped shape or a trapezoidal shape also in this case, is preferably progressively reduced in the crown curve shape in particular. Also when the thicknesses of both of these layers are progressively reduced, the methods of progressively reducing the thicknesses are preferably identical to each other, while the same may be different from each other.

In the aforementioned shoe press belt according to each of the first to fifth embodiments, methods of progressively increasing the depths of the drains formed on the right and left sides of the central pressurizing portion C-C' are preferably identical to each other, while the same may be different from each other.

(Shoe Press)

The shoe press according to the present invention at least comprises the aforementioned shoe press belt, a pressure shoe applying pressure to the shoe press belt and pressure regulation means regulating the pressure of the pressure shoe. The pressure shoe can be prepared from a generally known metal plate or the like, for example. The pressure regulation means can be prepared from generally known hydraulic cylinders or the like, for example.

Figure 6:
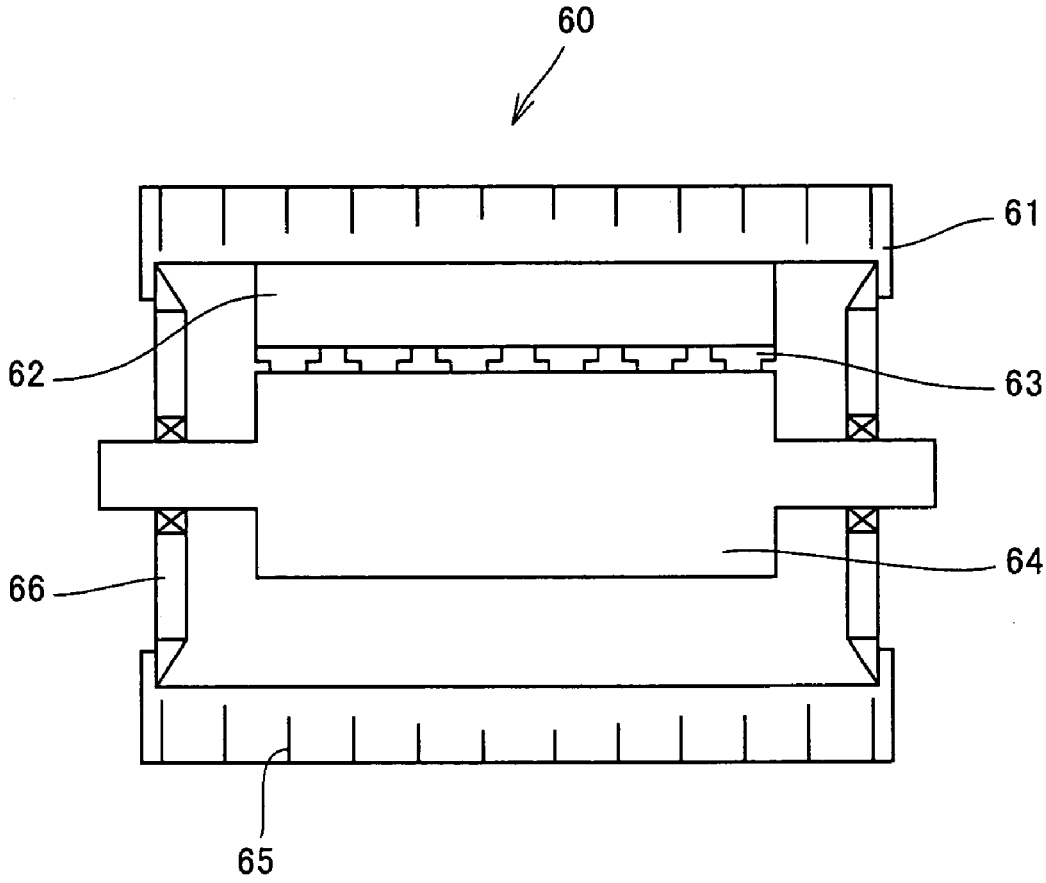
FIG. 6 is a schematic sectional view of an exemplary shoe press according to the present invention.
Figure 7:
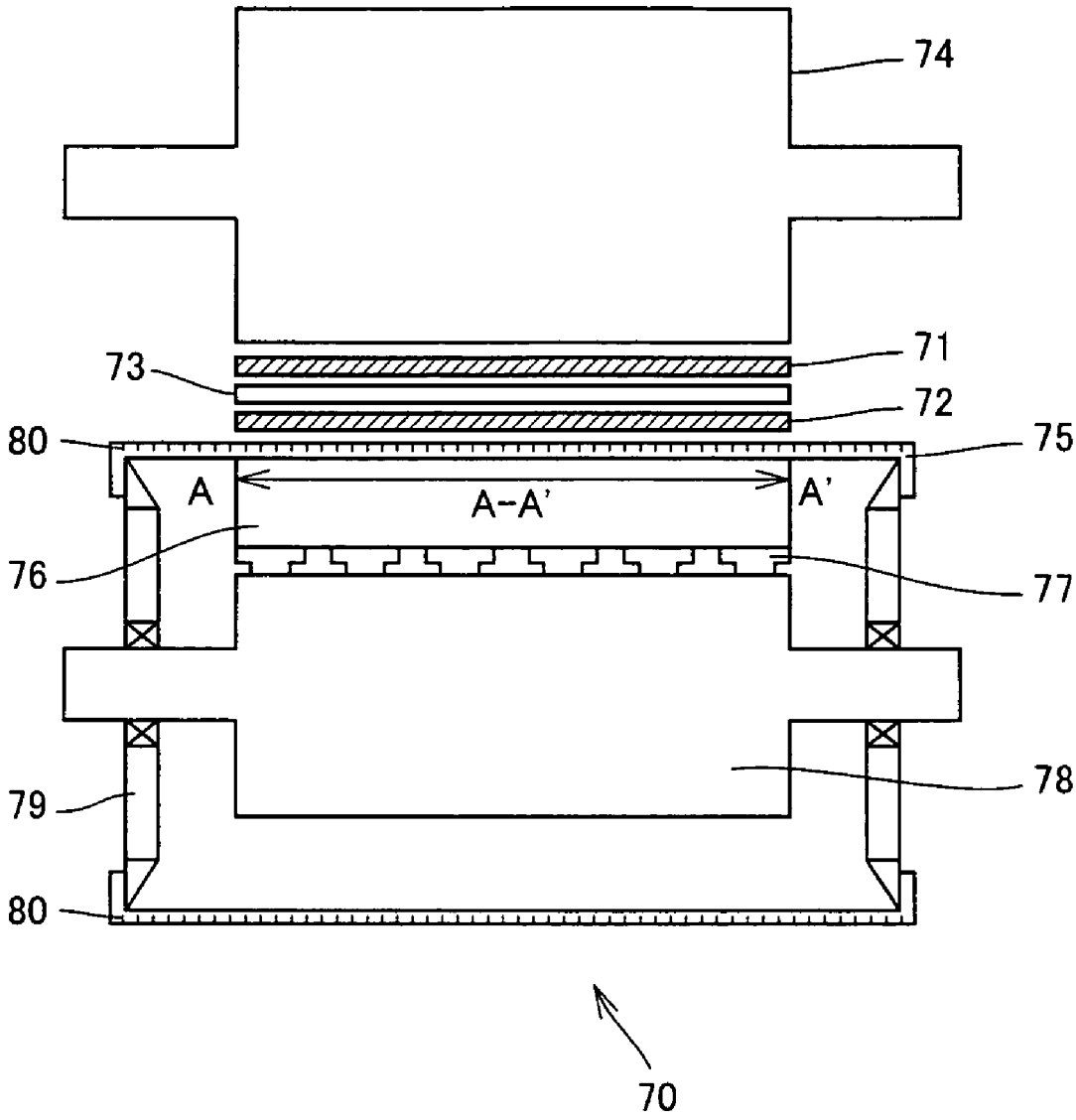
FIG.7 PRIOR ART
FIG. 7 is a schematic sectional view of an exemplary conventional shoe press.
Figure 8:
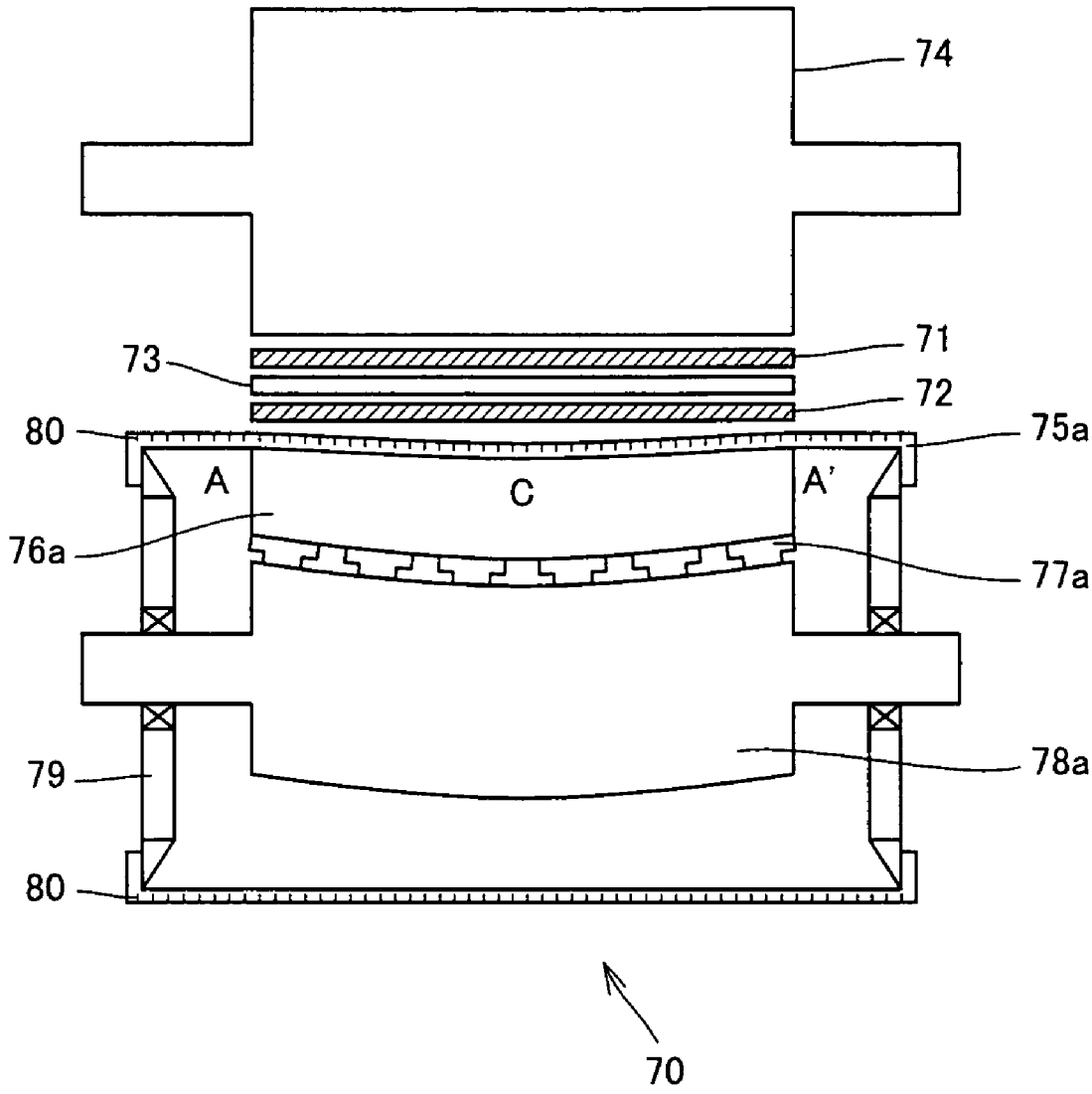
FIG.8 PRIOR ART
FIG. 8 is a schematic sectional view showing another exemplary conventional shoe press having a support deflected in the vicinity of a central pressurizing portion.

FIG. 6 is a schematic sectional view of an exemplary shoe press 60 according to the present invention. Referring to FIG. 6, both ends of a shoe press belt 61 are fixed to discs 66 of metal rotatably supported on both ends of an unrotating support 64 through bearings, so that the shoe press belt 61 rotates in a driven manner following rotation of an unillustrated counter press roll while sliding on a pressure shoe 62. The pressure shoe 62 of a metal plate is set on hydraulic cylinders 63 serving as pressure regulation means, and these hydraulic cylinders 63 are set on a metal support 64. The pressure of the pressure shoe 62 is regulated in response to the pressure of oil supplied to the hydraulic cylinders 63 through the support 64.

Wet web (not shown) transported to the aforementioned shoe press 60 is dehydrated due to pressure formed between the shoe press belt 61 forced up by the pressure shoe 62 and the depressed press roll (not shown).

The shoe press 60 according to the present invention employs the shoe press belt 61 having drains 65 whose depths are progressively increased from a central pressurizing portion toward end pressurizing portions. Also when a portion of the support 64 close to the central pressurizing portion is deflected downward and the end pressurizing portions of the shoe press belt 61 are worn due to the depression of the press roll (not shown) and the own weight of the support 64, therefore, the drains 65 formed in the end pressurizing portions keep depths sufficient for squeezing. When the shoe press 60 according to the present invention is employed, therefore, the overall wet web (not shown) can be so uniformly dehydrated that paper products can be prevented from reduction of the yield resulting from shutdown of a papermaking machine caused by web break or the like and the quality of the paper products themselves can also be improved since the paper strength is hardly dispersed.

The embodiments disclosed this time must be considered as illustrative in all points and not restrictive. The range of the present invention is shown not by the above description but by the scope of claim for patent, and it is intended that all modifications within the meaning and range equivalent to the scope of claim for patent are included.

INDUSTRIAL AVAILABILITY

According to the present invention, as hereinabove described, a shoe press belt capable of uniformly dehydrating the overall wet web and a shoe press employing the same can be so provided that paper products can be prevented from reduction of the yield resulting from web break or the like and the quality of the paper products themselves can also be improved.

The invention claimed is:

1. A shoe press belt endlessly formed by an elastic material, wherein a plurality of drains are formed in a pressurizing region which extends from a central pressurizing portion towards end pressurizing portions in the width direction of the shoe press belt, the depths of said drains being progressively increased from the central pressurizing portion toward end pressurizing portions of said shoe press belt.

2. The shoe press belt according to claim 1, wherein the depths of said drains are progressively increased from said central pressurizing portion toward said end pressurizing portions of said shoe press belt by at least one type of technique selected from the group consisting of a curve technique, a linear technique, a stepped technique and a trapezoidal technique.

3. The shoe press belt according to claim 1, wherein the depths of said drains are so progressively increased that the depth of the deepest drain formed in a pressurizing region of said shoe press belt is 1.05 to 3.0 times the depth of the shallowest drain formed in said pressurizing region.

4. The shoe press belt according to claim 1, wherein the thickness of said shoe press belt is progressively reduced from said central pressurizing portion to said end pressurizing portions of said shoe press belt.

5. A shoe press comprising at least the shoe press belt according to claim 1, a pressure shoe adapted to apply pressure to said shoe press belt and pressure regulation means for regulating the pressure of said pressure shoe.

* * * * *